United States Patent [19]

Marsh et al.

[11] 4,186,003

[45] Jan. 29, 1980

[54] HYBRID FIX SYSTEM INCORPORATING PHOTODEGRADABLE POLYMERS

[75] Inventors: Dana G. Marsh, Rochester; John M. Pochan, Webster, both of N.Y.

[73] Assignee: Xerox Corporation, Stamford, Conn.

[21] Appl. No.: 512,591

[22] Filed: Oct. 7, 1974

[51] Int. Cl.[2] ..... G03G 9/10; G03G 13/20

[52] U.S. Cl. ..... 430/97; 430/109; 430/98

[58] Field of Search ..... 96/1 SD, 35.1, 115 P; 252/62.1 P

[56] References Cited

U.S. PATENT DOCUMENTS

| | | | |
|---|---|---|---|
| 2,892,712 | 6/1959 | Plambeck | 96/36.3 |
| 3,196,032 | 7/1965 | Seymour | 252/62.1 P |
| 3,788,994 | 1/1974 | Wellman | 252/62.1 P |

*Primary Examiner*—Roland E. Martin, Jr.
*Assistant Examiner*—John L. Goodrow

[57] ABSTRACT

A novel toner system is provided employing a photodegradable toner. These toners are photodegradable during the fixing step in electrophotographic processes when they are exposed to light and then pressure or in the opposite sequences. This system provides excellent fixing of toner images at lower energy levels than is found in composition fixing systems.

12 Claims, No Drawings

HYBRID FIX SYSTEM INCORPORATING PHOTODEGRADABLE POLYMERS

BACKGROUND OF THE INVENTION

This invention relates to electrostatography and more particularly to improved electrostatographic developing materials fixing systems and the use thereof.

In electrostatography, more specifically recited in U.S. Pat. No. 2,297,691, a uniform electrostatic charge is placed on a photoconductive insulating layer, selectively exposed, and the resulting latent electrostatic image is developed to provide a visible reproduction of an original by depositing on the image a finely divided electroscopic marking material referred to in the art as "toner." Toner is normally attracted to those areas of the layer which retain a charge thereby forming a toner image corresponding to the electrostatic latent image. The image so produced may be transferred to a support surface or otherwise processed. The image may then be permanently affixed to the support surface employing conventional fixing methods such as heating or application of a suitable solvent.

Toner alone or in combination with a suitable carrier and additives, where appropriate, may be applied employing a number of development techniques among which are cascade, more fully defined in U.S. Pat. No. 2,618,552 to E. N. Wise; magnetic brush, more fully defined in U.S. Pat. No. 2,874,063; powder cloud, more fully defined by Carlson in U.S. Pat. No. 2,221,776; or touch-down development, as disclosed by Gundlach in U.S. Pat. No. 3,166,432; among others.

When fixing the final image by application of heat, problems in adapting such a technique to high-speed machines in view of the energy required to raise the temperature of the toner to the desired level, charring or combustion, and specifically adapting toner materials to these parameters for use in high-speed electrostatographic copying machines has resulted in the requirement for additional complex machinery and process techniques. The development of an appropriate toner material which will fuse under high-speed machine conditions and avoid blocking or caking, process readily and exhibit the appropriate triboelectric properties under changes in the ambient humidity has become a rather critical and demanding art in and of itself. Other characteristics and properties that must be controlled or eliminated in a desirable toner include the effects of impaction on the triboelectric properties the abrasive nature of the toner, and bead sticking which is the adherence of carrier beads to a reusable photoconductor surface.

Toner particles are usually comprised of thermoplastic resins selected to have melting points significantly above any ambient temperature that might be encountered during electrostatic deposition. In addition to the developing power or toner materials described in U.S. Pat. No. 2,297,691 a number of additional toner materials have been developed especially for use in the newer development techniques including the cascade development technique described above. Generally speaking, these new toner materials have comprised various improved resins mixed with different pigments such as carbon black and other colorants. Some examplary patents along this line include U.S. Pat. No. 2,659,670 to Copley which describes a toner resin as rosin modified phenyl formaldehyde, U.S. Pat. No. Re. 25,136 to Carlson which describes an electrostatographic toner employing a resin of polymerized styrene and U.S. Pat. No. 3,079,342 to Insalaco describing a plasticized copolymer resin in which the comonomers are styrene and a methacrylate selected from the group consisting of butyl, isobutyl, ethyl, propyl, and iso-propyl.

Generally, these toners have been prepared by thoroughly mixing a heat softened resin and a colorant to form a uniform dispersion as by blending these ingredients in a rubber mill or the like and then pulverizing this material after cooling to form it into small particles. These toners, though they result in excellent image reproductions, do exhibit some disadvantages such as a rather wide range of particle sizes and the ability of the colored resin to be sufficiently pliable for high-speed pulverizing which results in an even wider range of particle sizes during pulverization. Other requirements of electrostatographic developers or toners including the requirements that they be stable in storage, non-agglomerative, have the proper triboelectric properties for developing and have a low melting point for heat fusing are only compounded by the additional requirements imposed by this toner forming process. It is, therefore, found that some developer materials, such as those containing toner particles made from low molecular weight resins though possessing desirable properties such as proper triboelectric characteristics are unsuitable because they tend to cake, bridge, and agglomerate during handling and storage. Another significant problem in the case of conventional toners is the high energy requirements for heat fusing sources employed with these toners.

Electrostatographic developer materials which are pressure fixable have been considered in view of the above stated difficulties. However, it is found that the toner requirements for good machine performance tend to be diametrically opposed to the requirements for pressure fixing. That is, low toner impaction requires a high toner softening temperature and good mechanical strength while pressure fixing requires softening and viscous flow at room temperature. In addition, one of the problems with potential pressure fixable toners is the need to gently handle these materials prior to pressure fusion to paper or other suitable support medium so that these materials will not prefuse and cause impaction in the development chamber. Therefore, a balance must generally be made between a material which will pressure fix onto paper at low pressure but not yet impact in the development chamber. A major cause of such prefusion is the abrasive action of the tumbling carrier beads on the toner both in normal cascade development and magnetic brush development.

Electrostatographic toner materials which are capable of pressure fixing are desirable and advantageous since unencapsulated materials which undergo cold flow tend to form tacky images on the copy sheet which often offset to other adjacent sheets. Toner particles containing unencapsulated materials which undergo cold flow, tend to bridge, cake, and block during production and in the shipping container as well as in the electrostographic imaging machine. Of course, the toner material should be capable of accepting a charge of the correct polarity such as when brought into rubbing contact with the surface of carrier materials in cascade, magnetic brush, or touch-down development systems. Further, it is found that some toner materials which possess many properties as aforementioned which would ordinarily be desirable in electrostatographic toners dispense poorly and cannot be used in automatic copying and duplicating machines. Still other toners dispense well but form images which are characterized by low density, poor resolution, or high background. Still other toners are suitable for processes where electrostatic transfer is employed.

In addition to pressure fix systems, other systems of a so-called hybrid nature have been employed such as pressure-vapor fix system wherein both pressure and a solvent vapor are applied to accomplish fixing or other combinations of heat, pressure and solvent fixing. Because of the energy requirements associated with heat fusing and the handling of an enviromental problem associated with vapor fusing there is a demonstrated need for improved toner fixing systems.

It is, therefore, an object of this invention to provide a toner fixing system which is devoid of the above noted deficiencies.

Another object of this invention is to provide a toner fixing system which employs substantially reduced energy levels.

Again another object of this invention is to provide a novel toner system.

Yet another object of this invention is to provide a toner which is stable at toner fusing conditions in high-speed copying and duplicating machines.

Still another object of this invention is to provide an impaction resistant toner material.

Again, another object of this invention is to provide a toner material which is resistant to smearing, agglomeration, and may be fused readily with less heat energy.

Yet still another object of this invention is to provide a toner which reduces mechanical abrasion of electrostatic imaging surfaces and is effective at low initial electrostatic surface potentials to provide dense toner images.

Again another object of this invention is to provide a toner which allows toner fixing at higher rates with less pressure.

These and other objects of the present invention are accomplished generally speaking by providing a photodegradable toner system. More specifically novel toner compositions are provided which comprise photodegradable polymers so that when employed in a xerographic process these toners may be applied to render a latent electrostatic image visible employing conventional techniques and thereafter be fixed employing a hybrid fixing system which utilizes the photodegradability of the toner material itself. The toner of the instant invention is therefore, applied either by itself or in connection with a carrier in the form of a developer during the developing step in a conventional electrophotographic process. Thereafter it is fixed e.g. by exposure to activating radiation which degrades the photodegradable polymer relieving the stress of the polymer and thereby allowing it to become affixed to the substrate on which it is deposited, followed by the application of pressure. In employing such a hybrid e.g., a combination of light and then pressure stress relief fixing system, substantially lower energy levels may be employed than is found in conventional pressure fix systems and in addition the solvent vapor step with its accompanying drawbacks is eliminated as found in other hybrid systems. Although pressure followed by light exposure may be employed to obtain satisfactory fixing the sequence of light exposure followed by application of pressure yield more desirable results. Photo fixing has certain advantages to normal heat fusing among which are the utilization of lower energy requirements, less fire hazard in electrophotographic imaging machines and the possibility of employing less complicated types of paper stocks. Polymer degradation may, therefore, be employed of the free radical type which involves decomposition by random chain scissions as well as depolymerization to monomer to effect efficient hybrid flash-pressure fixing. This may either be accomplished by providing a toner material wherein a solvent which effects the stress relaxation is formed in situ by photochemical process or alternatively a photodegradable polymer is allowed to degrade to lower "mers" which will simultaneously lower the viscosity and plasticize undegraded polymer thereby enhancing fixability in the hybrid fixing mode.

The present toner system comprises a degradable polymeric composition containing segments characterized by the formula:

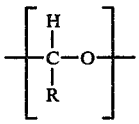

where R may be H, an alkyl(group) of 1 to 6 carbon atoms, a chlorine or fluorine substituted radical of 1 to 6 carbon atoms or a cyano substituted aliphatic hydrocarbon radical of 1 to 5 carbon atoms; a halogenated polymer; and a photoactive agent which upon activation is capable of abstracting a hydrogen atom from the polymer backbone of said degradable polymeric composition and halogenated polymer.

Suitable degradable polymers for use in the toner system of the instant invention can be prepared by the polymerization of aldehydes to give polymers which correspond to the formula previously set out. When aldehydes which contain alkyl groups of 1 to 6 carbon atoms attached to the carbonyl carbon atom are polymerized, polymers result in which the R moiety corresponds to the alkyl group of the aldehyde. Examples of aldehydes which contain such moieties include acetaldehyde, propionaldehyde, n-butyraldehyde, isobutyraldehyde, valeraldehyde and heptaldehyde. The R moiety may also be hydrogen as is the case with poly(formaldehyde).

Alternatively, the aldehyde may contain a chlorinated or fluorinated hydrocarbon radical of from 1 to 6 carbon atoms to provide a polyaldehyde in which the R moiety corresponds to the group attached to the carbonyl carbon of the aldehyde. Examples of such aldehydes include chloroacetaldehyde, dichloroacetaldehyde, chloropropionaldehyde, chlorobutyraldehyde, chlorovaleraldehyde, chloroheptaldehyde, trifluoroacetaldehyde, trifluoropropionaldehyde, chlorodifluoroacetaldehyde and fluoroheptaldehyde.

In addition, aldehydes which contain cyano substituted aliphatic hydrocarbon radicals containing from 1 to 5 carbon atoms attached to the carbonyl carbon can be polymerized to form degradable polymers useful in the process of the instant invention. Examples of these aldehydes include cyanoacetaldehyde, beta-cyanopropionaldehyde and 5-cyanopentaldehyde.

When homopolymers of the above-described aldehydes are used in the process, the degradable polymer can be represented by the formula:

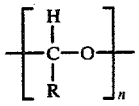

wherein R is as defined above and n is a number representing the degree of polymerization. The degree of polymerization of the homopolymer may be quite low as in the case of oligomers or as high as the realities of the polymerization of the aldehyde permit. In general, those polyaldehydes characterized by the foregoing formula in which n is a number within the range of from 50 to 50,000 are preferred for use in the instant invention.

In addition to homopolymers of the desired aldehydes, copolymers containing degradable segments characterized by the foregoing formula can be employed in the process of the instant invention. For example, copolymers and block copolymers may be prepared from one or more of the aldehydes previously described and other polymerizable constituents such as styrene, isoprene, η-methylstyrene, methylmethacrylate, phenyl isocyanate and ethyl isocyanate. In addition, the degradable segments may occur as side chains appended from the backbone of another polymer.

Suitable halogenated polymers are those which conform to the formula:

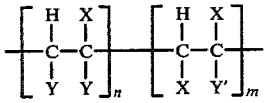

In the above formula, X is chlorine or bromine, Y and Y' are X or hydrogen and Z is Y or an alkyl, aryl or alkaryl constituent containing from 1 to 8 carbon atoms.

The symbols n and m represent numbers which designate the relative mole percent composition of the individual units in the polymer and can vary from 0 to 100 with the sum of n% and m% being 100. Thus, when Y is hydrogen and n is 100, the formula depicts a poly(-vinylhalide), e.g., poly(vinylchloride), when X is chlorine. When Y' is X, Z is H and m is 100, a poly(-vinylidenehalide) is depicted. When Y and Y' are as defined above, and n and m are numbers between 0% and 100%, a copolymer of a vinylhalide and a vinylidenehalide is depicted. These polymers can be substituted with organic constituents such as when Z is an alkyl, aryl or alkylaryl radical. Examples of organic constituents which Z represents include methyl, ethyl, propyl, n-butyl, isobutyl, octyl, phenyl, substituted phenyl, e.g., methylphenyl and ethylphenyl. Polymers containing units corresponding to the above formula which are copolymerized with other monomeric units such as vinylacetate, ethylene, propylene, methylacrylate, ethylacrylate, methylmethacrylate, ethylmethacrylate, styrene, η-methylstyrene, ring substituted styrenes and acrylonitrile are also useful.

Useful photoactive agents include those compounds which, upon activation, are capable of abstracting a hydrogen atom from the backbone of the degradable polymers. While the process of the instant invention is not predicated upon any particular theory of operation, it is believed that upon irradiation the photoreactive reagent may abstract an H atom from the polyaldehyde backbone thereby forming a free radical species on a carbon atom. At this point, chain cleavage occurs as the result of the rearrangement of electrons in a carbon-oxygen sigma bond and polymer degradation occurs whereby the molecular weight of the polymer is greatly reduced. Simultaneously, the photoactive reagent removes an H atom from the halogenated polymer resulting in the formation of hydrogen halide which causes further degradation of the polyaldehyde.

A preferred class of photoactive agents is made up of those compositions which, when subjected to activating radiation, assume a $^3(n,\pi^*)$ or $^1(n,\pi^*)$ state. Many compositions are available which are capable of assuming such a state and are thereby able to abstract a hydrogen atom from the polymer backbone. In general, five classes of compounds are capable of assuming such an excited state and abstracting a hydrogen atom. These classes are:

1. Carbonyl compounds with reactive $^3(n,\pi^*)$ states such as for example, benzophenone, 2-tert-butylbenzophenone, 4-aminobenzophenone, and 4-phenylbenzophenone; substituted acetophenones, e.g., 4-methoxyacetophenone, and aldehydes, e.g., benzaldehyde and anisaldehyde.
2. Thiocarbonyl compounds such as for example, thiobenzophenone, 4,4-dimethoxythiobenzophenone, substituted thiobenzophenones, thioacetophenone and substituted thioacetophenones.
3. Aromatic nitro compounds having reactive $^3(n,\pi^*)$ states such as nitrobenzene and 1,2-dinitro-3,4,5,6-tetramethylbenzene.
4. Arylimines and alkylimines having reactive $^3(n,\pi^*)$ states such as N-alkylbenzophenoneimine and benzophenone-N-hexylimine.
5. Aromatic amines having reactive $^1(n,\pi^*)$ states such as acridine and phenazine.

Another class of photoactive agents useful in the invention is that of organic peroxides such as for example, dibenzoylperoxide, tert-butylperoxide, 2,4-dichlorobenzoylperoxide and cumylperoxide. In general, those organic peroxides which form free radicals and thereby are able to abstract hydrogen atoms are useful.

An additional class of hydrogen abstracting compounds which can be used in the invention is made up of organic halides, for example, alkyl halides such as carbon tetrachloride, chloroform, carbon tetrabromide and bromoform.

The relative concentrations of degradable polymer, halogenated polymer and photoactive agent may vary widely. The degradable polymer is employed in an effective amount, i.e., that amount which when degraded will produce sufficient stress relaxation to allow fixing of the toner. Preferably, the degradable polymer will make up from 1 to 49 weight percent of the composition. The photoactive agent should be present in an effective amount, i.e., that amount which will increase the rate of degradation of the degradable polymer to a noticeable extent. A preferred concentration of photoactive agent is from 0.01 to 5 weight percent of the composition. Larger amounts can be used but are not preferred for economic reasons. In addition, too large a concentration of photoactive reagent will result in phase separation due to its crystallization. The balance of the composition is made up of the halogenated polymer and optionally additional elements which do not destroy the basic and novel characteristics of the composition.

Activating radiation, as used herein, is intended to refer to electromagnetic radiation having wavelengths within the range which will excite the photoactive reagent. In most cases, the radiation will be in the ultraviolet region, however, certain photoactive reagents such as the thiocarbonyl compounds are excited by light in the visible or near ultraviolet part of the spectra. When benzophenone is used as the photoactive reagent, irradiation in the ultraviolet range is employed with UV light having wavelengths from 250 to 370 nm being preferred.

The exposure time will vary widely depending on the relative concentrations of halogenated polymer, polyaldehyde and photoreactive agent in the toner and the intensity and wavelength of the activating radiation. Thus, optimum exposure time for a given toner in order to achieve the desired degree of polymer degradation may require some routine experimentation, but would not require the application of inventive skill. In general irradiation at a minimum of 0.1 watt-sec./cm$^2$ should be employed, while irradiation sufficient to provide 0.5 watt-sec./cm$^2$ is found to perform satisfactorily. If one were to employ a conventional P.E.K. Inc. 100 watt high pressure compact point source mercury arc, at least a 5 second exposure would be required. If a conventional Xenon Corporation flash lamp such as the Novatron 213-A were to be employed and operated at a 300 watt input with pulses having $10^{-5}$–$10^{-4}$ second pulse durations, the necessary exposure energy could occur in $10^{-3}$ second total exposure time.

It is found that the degree of fix obtained for these toner materials is related to light exposure, sensitizer loading, carbon black distributions and toner particles (ability to absorb light for a flash fusing) and pressure roll speeds.

The photodegradable polymeric material is described above is admixed with a suitable colorant such as, for example, carbon black and a suitable electrophotographic resin especially when this toner material is to be employed in a multiphase form as in an encapsulated toner composition to provide a toner material. Thus the toner could be fabricated of photodegradable polymer which would pressure fix and subsequently partially photodegrade giving the hybrid fix desired or it could be employed in a combination, for example a polyblend or encapsulated toner block copolymeric composition or other form with standard toner polymeric materials for example styrene/alkylmethacrylate compositions etc. In the case of encapsulated toners and other multiphase toners the weight % of photodegradable polymer based on the total weight of composition is from 1 to 49. When polymers are combined, the criterion for the monomer obtained through photodegradation would be that it relaxes the stressed photolytically inert matrix polymer for example, by solvolysis, plasticization, or other mechanistic means. Thus, for example, a toner material comprising polystyrene encapsulated polyacetaldehyde and benzophenone and a carbon black colorant may be provided by conventional spray drying techniques to provide toner particles having a diameter of for example, 15 to 20 microns on the average having dispersed therein smaller domains of polyacetaldehyde for example 0.5 microns diameter and carbon black. This toner material may then be mixed with a conventional carrier and applied to an electrostatic latent image formed through a conventional process including the steps of charging an electrophotographic member and exposing said member. The resulting visible image may then be fixed by a hybrid fixing step including the steps of applying pressure followed by application of activating radiation resulting in the properly fixed xerographic image.

The following examples are given to aid in understanding the invention, but it is to be understood that the invention is not restricted to the particular times, proportions, components and other details of the examples.

EXAMPLE I

A toner material is prepared by spray drying the following composition: 9.5 grams polystyrene, 0.5 grams poly(dichloroacetaldehyde), 0.5 grams carbon black, 0.005 grams benzophenone and 500 millileters of a 2:3 volume ratio of chloroform and hexane. The carbon black is dispersed and wetted in the chloroform solvent 24 hours prior to spray drying. Polystyrene, benzophenone, and poly(dichloroacetaldehyde) are dissolved in chloroform blended with the carbon black solution and finally hexane is added just before spray drying. The largest particles obtained are found to be about 20 microns in diameter. The carbon black is encapsulated in the polystyrene matrix. A conventional carrier is added and the resulting developer is then employed in the conventional electrophotographic process by applying the same to a latent electrostatic image followed by application of light and then pressure resulting in an appropriately fixed electrophotographic image. The hybrid fixing is accomplished by subjecting the toner image to a flash from a high energy flash lamp (213A-Xenon Corporation), positioned at the foci of specially designed parabolic reflector operated at 350 joules maximum input having a rise time of 0.3 μsec. and a pulse duration (½ peak height width) of 10–100 μsec., delivering to the paper toner surface a light intensity of $6\times10^6$ erg/cm$^2$/flash followed immediately by pressure fixing at 400 pli at 10″ per sec.

EXAMPLE II

Example I is again performed with the exception that two light flashes are employed.

EXAMPLE III

The procedure as outlined in Example I is again performed with the exception that the pressure fixing is performed at 5″ per sec. and 400 pli.

EXAMPLE IV

The procedure as outlined in Example I is again performed with the exception that a hybrid fixing sequence of pressure applied at 400 pli at 5″ per sec. followed by 1-flash is employed.

EXAMPLE V

The procedure as outlined in Example IV is again performed with the exception of the light exposure step employs 2-flashes.

EXAMPLE VI

Poly(acetaldehyde) is prepared by polymerizing acetaldehyde monomer cationically at −100° C. in liquid ethylene using $BF_3$- etherate as an initiater. The polymer is reacted immediately with acetic anhydride in the presence of pyridene to convert the hemi-acetal end groups to acetate end groups. The end-capped polymer is precipitated three times in distilled water, redissolved in benzene, dryed over anhydrous magnesium sulphate and then freeze dried. The polymer molecular weight Mw=500,000 is subsequently stored in amber bottles at −20° C. This polymer along with polystyrene having an Mw=39,000, Mn=7,000, and MWD−5.57 and Tg of 68°-70° C. is dissolved in a chlorobenzene solvent and this solvent-solute system is directed through a 23-26 gauge hypodermic needle at variable feed rates upon an air driven rotating desk whose velocity is controlled by air pressure. The solute-solvent system is instantly converted into an aerosol and upon solvent evaporation solid spherical particles result. A toner material including 10.35 grams of polystyrene, 1.15 grams of polyacetaldehyde produced above and benzophenone at 0.18 grams is spray-dried from 250 milliliters of chlorobenzene at 40° C. This mixture is redissolved in chlorobenzene with 0.14 black colorant thoroughly dispersed and then spray dried to form toner. This material is loaded at 1% by weight onto a conventional carrier and ball milled at room temperature for 4 hours. The toner material is then applied to an electrostatic latent image to form a visible toner image. The toner image is pressure fixed at 400 pli at a roller speed 10" per sec. followed by illumination at 200 J from a Xenon lamp flash at a distance of 2" followed by a 200 J flash (Stroboflash 4) at 1". Acceptable but not high quality fix is obtained.

EXAMPLE VII

The procedure as outlined in Example VI is again performed with the exception that the pressure and flash exposure sequence is reversed so that flash exposure is employed followed by pressure fixing. Noticeably better fixing is obtained than observed in Example VI.

Although the present examples were specific in terms of conditions and materials used, any of the above listed typical materials may be substituted when suitable in the above examples with similar results. In addition to the steps used to carry out the process of the present invention, other steps or modifications may be used if desirable. In addition, other materials may be incorporated in the system of the present invention which will enhance, synergize or otherwise desirably affect the properties of the systems for their present use.

Anyone skilled in the art will have other modifications occur to him based on the teachings of the present invention. These modifications are intended to be encompassed within the scope of this invention.

What is claimed is:

1. A toner comprising a colorant and a photodegradeable polymer containing segments satisfying the formula:

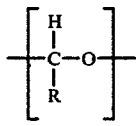

where R is H, an alkyl group of 1 to 6 carbon atoms, a chlorine or fluorine substituted group of 1 to 6 carbon atoms or, a cyano substituted aliphatic hydrocarbon group of 1 to 5 carbon atoms; and a photoactive agent which upon activation is capable of abstracting a hydrogen atom from the polymer backbone of said photodegradable polymeric composition.

2. The toner as defined in claim 1 wherein the segment is selected from the group consisting of acetaldehyde, propionaldehyde, n-butyraldehyde, isobutyraldehyde, valeraldehyde and heptaldehyde.

3. The toner as defined in claim 1 wherein said segment is selected from the group consisting of chloroacetaldehyde, dichloroacetaldehyde, chloropropionaldehyde, chlorobutyraldehyde, chlorovaleraldehyde, chloroheptaldehyde, trifluoroacetaldehyde, trifluoropropionaldehyde, chloro-difluoroacetaldehyde and fluoroheptaldehyde.

4. The toner as defined in claim 1 wherein said segment is selected from the group consisting of cyanoacetaldehyde, beta-cyanopropionaldehyde and 5-cyanopentaldehyde.

5. The toner as defined in claim 1 wherein said photoactive reagent is a compound selected from the group consisting of carbonyl compounds, thiocarbonyl compounds, aromatic nitro compounds, arylimines, alkylimines, aromatic amines, and organic peroxides.

6. The toner as defined in claim 5 wherein the photoactive reagent is present in an amount from 0.01 to 5 weight percent of the composition.

7. The toner as defined in claim 1 wherein said photoactive reagent is benzophenone.

8. The toner as defined in claim 1 further comprising a carrier.

9. An improved electrophotographic fixing process comprising the steps of providing a photoconductive insulating layer, selectively exposing said layer to form a latent electrostatic image, developing said image and fixing said image, the improvement which comprises employing a photodegradable polymer toner comprising a colorant and a photodegradable polymer composition containing segments which satisfy the formula:

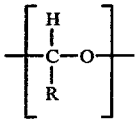

where R is H, an alkyl group of 1 to 6 carbon atoms, a chlorine or fluorine substituted group of 1 to 6 carbon atoms or a cyano substituted aliphatic hydrocarbon group of 1 to 5 carbon atoms; and a photoactive agent which upon activation is capable of abstracting a hydrogen atom from the polymer backbone of said photodegradable polymer composition during said developing step and employing exposure to light to photodegrade said photodegradable polymer and the application of pressure to said polymeric toner image during said fixing step.

10. The process as defined in claim 9 wherein said fixing step is performed by first exposing to light and then applying pressure.

11. The process as defined in claim 9 wherein said fixing is accomplished by first applying pressure and then exposing to light.

12. The process as defined in claim 9 wherein said photoactive reagent comprises a compound selected from the group consisting of carbonyl compounds, thiocarbonyl compunds, aromatic nitro compounds, arylimines, alkylimines, aromatic amines, and organic peroxides.

* * * * *